US005446268A

United States Patent [19]

Chen

[11] Patent Number: 5,446,268

[45] Date of Patent: Aug. 29, 1995

[54] HEAT RADIATING DEVICE OF INDUCTION HEATER

[75] Inventor: Su-Min Chen, Chaing Hwa Hsein, Taiwan

[73] Assignee: Superluck Electrics Corp., Chang Hwa Hsein, Taiwan

[21] Appl. No.: 223,691

[22] Filed: Apr. 6, 1994

[51] Int. Cl.[6] ..... H05B 6/12

[52] U.S. Cl. ..... 219/623; 126/21 A; 219/632

[58] Field of Search ..... 219/623, 622, 632; 126/21 A

[56] References Cited

U.S. PATENT DOCUMENTS

| | | | |
|---|---|---|---|
| 4,415,788 | 11/1983 | Field | 219/623 |
| 4,490,596 | 12/1984 | Hirai et al. | 219/623 |
| 4,549,052 | 10/1985 | Simon | 219/623 |
| 4,899,028 | 2/1990 | Arai et al. | 219/623 |
| 5,019,682 | 5/1991 | Lee | 219/623 |

FOREIGN PATENT DOCUMENTS

| | | | |
|---|---|---|---|
| 1-105489 | 4/1989 | Japan | 219/623 |
| 5-21148 | 1/1993 | Japan | 219/623 |

*Primary Examiner*—Philip H. Leung

*Attorney, Agent, or Firm*—Browdy and Neimark

[57] ABSTRACT

The heat radiating device of an induction heater comprises a body, a heat radiating unit, and a ventilating unit. The body comprises a bottom housing provided at the front end thereof with a plurality of air admitting holes. The heat radiating unit is mounted on the air admitting holes and composed of a fan. The ventilating unit is disposed in the upper portion of the rear end of the body and provided with a ventilating seat and a horizontal air duct with an outlet whose level is higher than the bottom of the mounting portion of the body. The cool air is drawn in form the air admitting holes while the hot air is let out from the ventilating holes of the ventilating unit.

1 Claim, 5 Drawing Sheets

HEAT RADIATING DEVICE OF INDUCTION HEATER

FIELD OF THE INVENTION

The present invention relates to a heat radiating device of an induction heater.

BACKGROUND OF THE INVENTION

A desk top induction heater is provided peripherally with a heat radiating device. As a result, the heat generated by the induction heater can be easily radiated. However, an induction cooker is generally housed in a kitchen cabinet, with only the receiving plate and the operation plate being exposed. As a result, the heat radiating device should not be disposed in the side or the bottom of the induction cooker. In addition, if the air exhausting port faces upwards, it is very likely that the spill of the cooking liquid can enter the interior of the induction cooker to cause the breakdown of the component parts of the induction cooker.

SUMMARY OF THE INVENTION

The primary objective of the present invention is to provide a heat radiating device of an induction heater with an air inlet and an air outlet, which are capable of radiating heat effectively and preventing the spill of the cooking liquid from entering the interior of the induction heater.

Another objective of the present invention is to provide a heat radiating device of an induction heater with an air outlet capable of blowing the hot air out through the air outlet.

The foregoing objectives of the present invention are attained by an induction heat, which comprises a body, a heat radiating unit, and a ventilating unit. The body comprises a bottom housing provided at the front end thereof with a plurality of air admitting holes. The heat radiating unit is mounted on the air admitting holes and composed of a fan. The ventilating unit is disposed in the upper portion of the rear end of the body and provided with a ventilating seat having an inverted L-shaped cross section and a horizontal air duct with an outlet whose level is higher than the bottom of the mounting portion of the body. The cool air is drawn in from the air admitting holes while the hot air is let out from the ventilating holes of the ventilating unit.

DETAILED DESCRIPTION OF THE INVENTION

Figure 1:
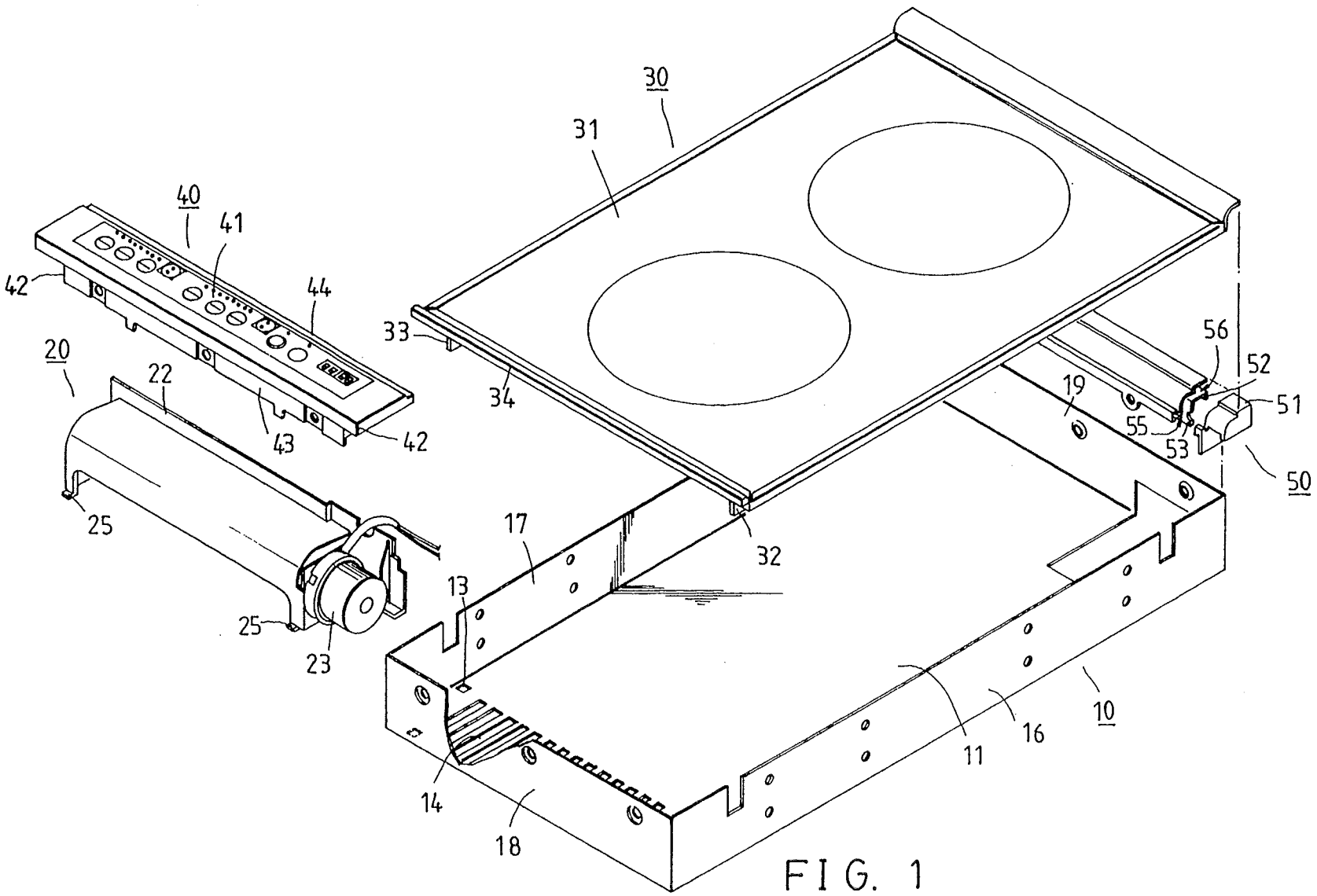
FIG. 1 shows an exploded view of a heat radiating device of a first preferred embodiment of the present invention.
Figure 2:
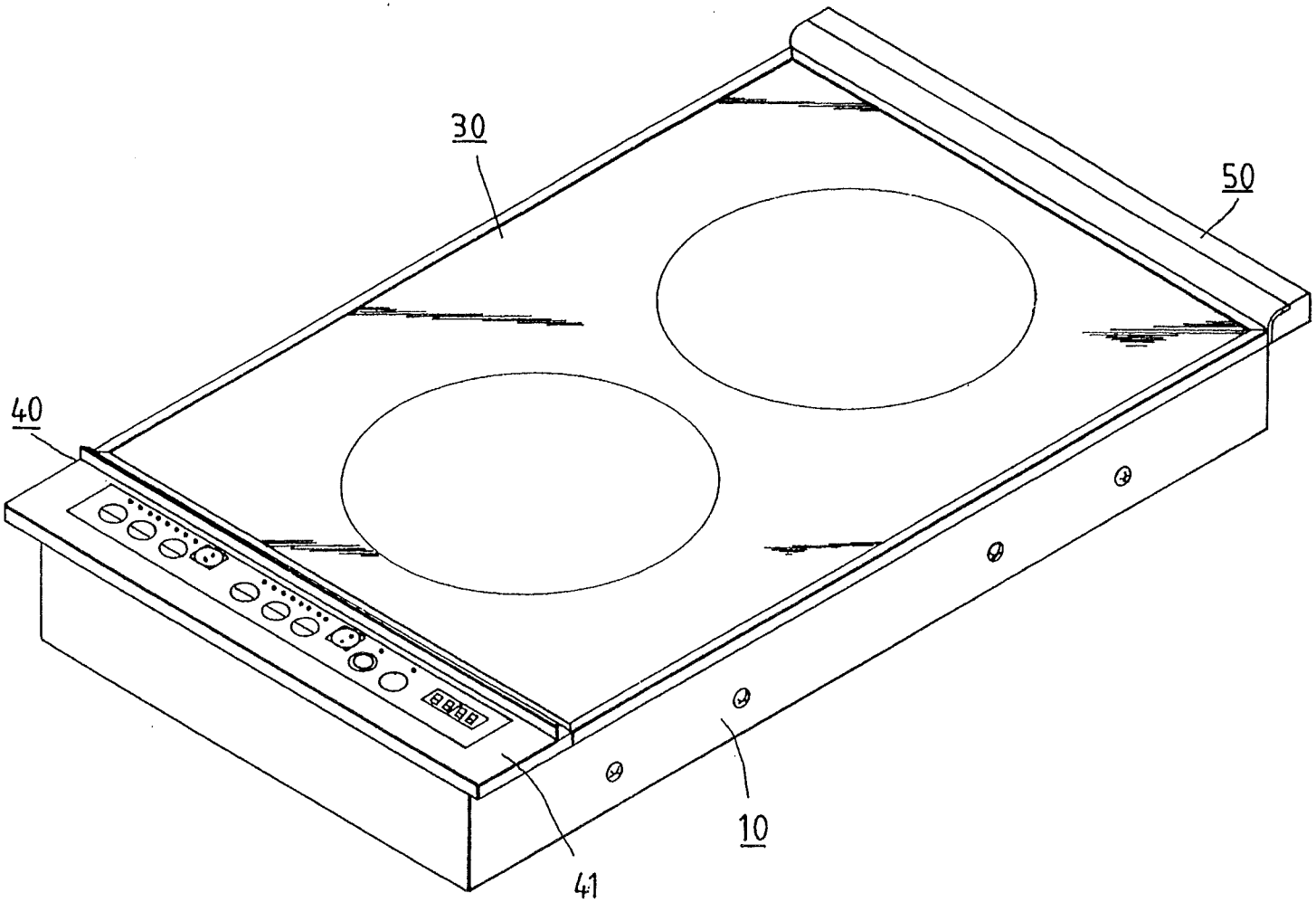
FIG. 2 shows a perspective view of the first preferred embodiment of the present invention.
Figure 3:
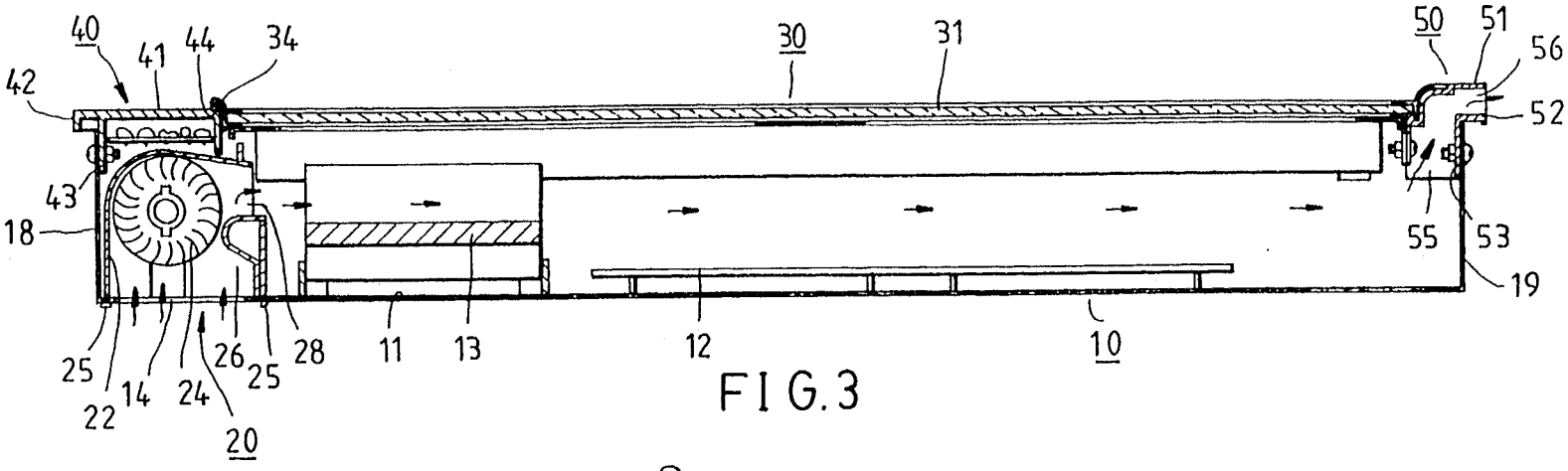
FIG. 3 is a sectional schematic view of the heat radiating device of the first preferred embodiment of the present invention.

Referring to FIGS. 1–3, a heat radiating device of an induction heater embodied in the present invention is shown to comprise a bottom housing 10 provided therein with an air admitting and heat radiating unit 20 and provided thereon with a receiving portion 30 which in turn is provided at the front end thereof with a face plate unit 40 having at the rear end thereof an air ventilating unit 50.

The bottom housing 10 of rectangular construction has a bottom plate 11 provided thereon with a plurality of circuit boards 12 and heat radiating pieces 13, as shown in FIG. 3. The bottom plate 11 is provided at the front end thereof with a predetermined number of air admitting holes 14 and retaining holes 13. Mounted on the air admitting holes 14 is the air admitting unit 20.

The air admitting unit 20 is composed of a fan seat 22 and a motor 23 for driving a fan 24 mounted on the fan seat 22 which is provided at the bottom thereof with a predetermined number of tenons 25. The fan 24 is received in a receiving space 26 having an air outlet 28, as shown in FIG. 3.

The receiving portion 30 comprises mainly a rectangular receiving plate 31 of a ceramic or heat-resisting material and having two frame strips 32 and 33 capable of being fastened to the two side plates 16 and 17 of the bottom housing 10 by means of screws (not shown in the drawings.) The face plate unit 40 comprises mainly a plastic housing provided at the top thereof with an operation face plate 41 having a plurality of operating keys and further provided at the front thereof with a front frame 42 for fitting into the upper edge of the bottom housing 10. The face plate unit 40 is further provided with a retaining plate 43 extending downwards from the bottom thereof. The retaining plate 43 is engageable securely with a front end plate 18 of the bottom housing 10.

The air ventilating unit 50 is located behind the receiving portion 30 and composed of a ventilating seat 51 and a horizontal frame 52 engageable with a rear end plate 19 of the bottom housing 10. The ventilating seat 51 has an inverted L-shaped air duct 55 with an air ventilating hole 56 located above the bottom housing 10 and facing horizontally the back of the heater to prevent the entry of a foreign object or the liquid into the inside of the heater.

In combination, the tenons 25 of the fan seat 22 of the heat radiating unit 20 engage respectively with the retaining holes 13 of the bottom plate 11. The fan 24 is aligned with the air admitting hole 14. The face plate unit 40 is fastened over the heat radiating unit 20 such that the front horizontal frame 42 engages the inner edge of the front end plate 18 of the bottom housing 10. The front edge 34 of the receiving portion engages the rear edge 44 of the face plate 41. The ventilating seat 51 has an insertion frame 53 engaging the rear end plate 19 of the bottom housing 10 such that the receiving portion 30, the face plate unit 40 and the ventilating seat 51 is fastened to the bottom housing 10.

Figure 4:
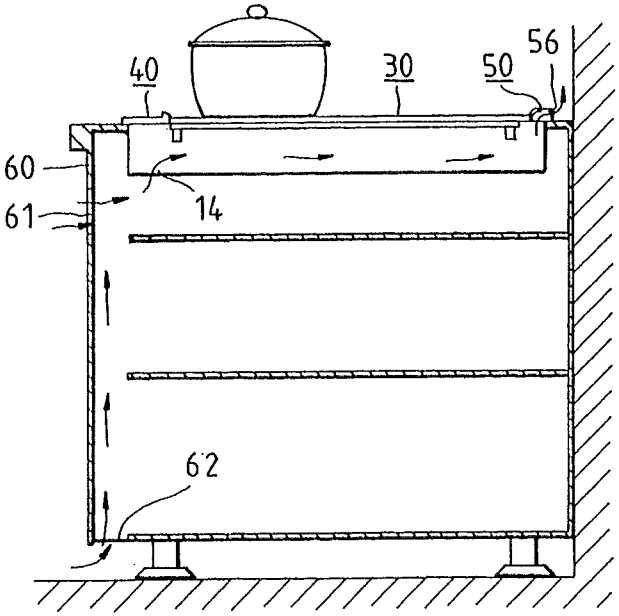
FIG. 4 is a schematic view showing the way that the heat is radiated by the heat radiating device of the induction heater housed in a kitchen cabinet, according to the present invention.

As shown in FIGS. 3 and 4, the heat radiating device of the induction heater is mounted at the top portion of a kitchen cabinet 60. In operation, the air is let in via the inlets 61 and 62. The air is the blown by the fan 24 to enter the interior of the heater via the air admitting holes 14 and the air outlet 28, as indicated by the arrows in the drawings. The air is then let out via the ventilating hole 56 of the ventilating Seat 51.

Figure 5:
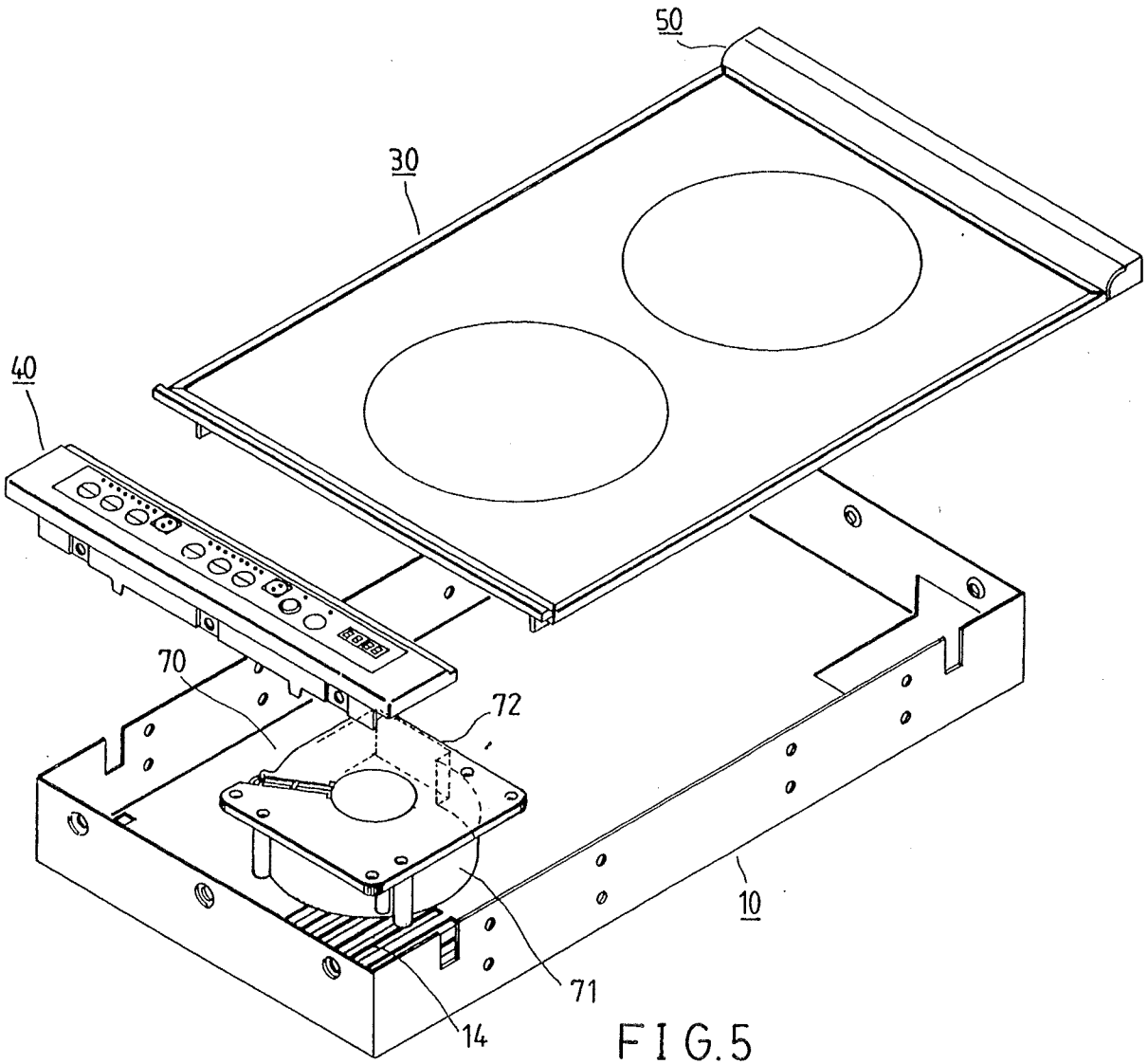
FIG. 5 shows an exploded view of a heat radiating device of a second preferred embodiment of the present invention.

As shown in FIG. 5, another preferred embodiment of the present invention is similar in construction to the first preferred embodiment of the present invention described above, with the difference being that the air admitting unit 70 is provided with a square fan 71 fastened to the air admitting holes 14. The air outlet 72 of the fan 71 faces the interior of the heater for radiating the heat. The fan 71 is different in structure from the fan 24 of the first preferred embodiment and can be made and installed easily.

Figure 6:
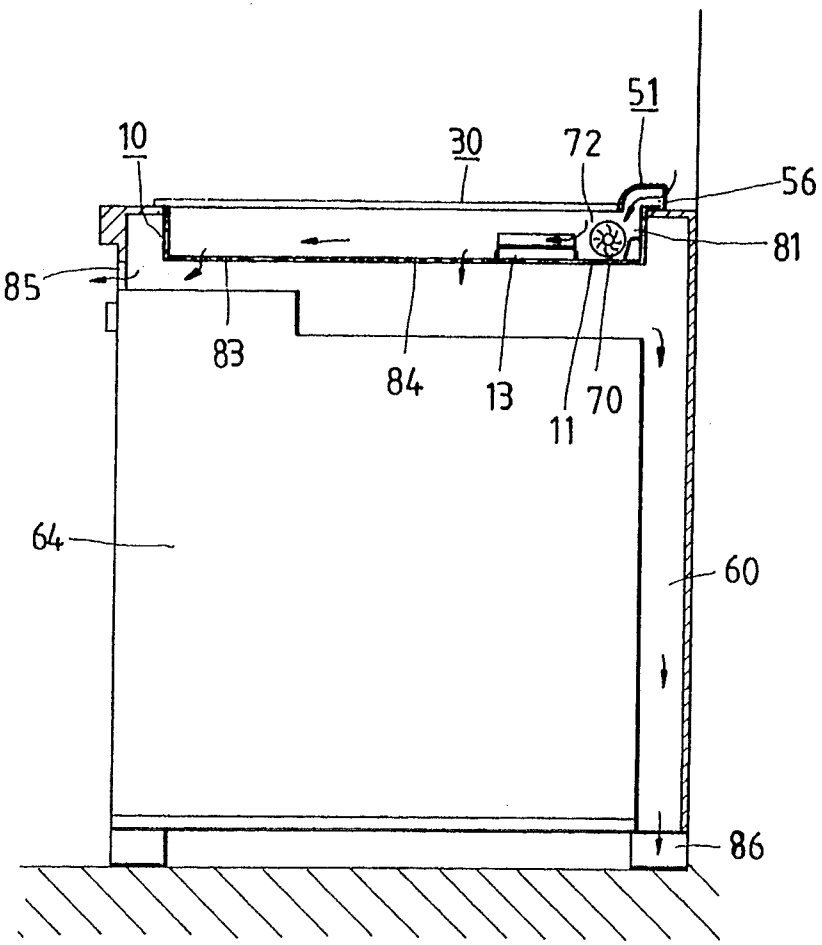
FIG. 6 is a schematic view showing the way that the heat is radiated by the heat radiating device of the induction heater housed in a kitchen cabinet, according to a third preferred embodiment of the present invention.

Now referring to FIG. 6, the third preferred embodiment of the present invention is shown to comprise a housing 10, a receiving portion 30 and a ventilating seat 51 and is intended for use in conjunction with an oven. As shown in FIG. 6, a kitchen cabinet 60 is provided with an oven 64. A fan 80 is set up at the rear end of the bottom housing 10. In other Words, the fan 80 is located at the end contiguous to the ventilating seat 51, which is provided horizontally with a ventilating hole 56. The fan 80 has an air inlet 81 in communication with the ventilating hole 56. The fan 80 further has an air outlet 82 facing a heat radiating plate 13. The bottom plate 11 is provided with two heat-radiating holes 83 and 84. In operation, the air which is sucked in via the ventilating hole 56 of the ventilating Seat 51 by the fan is blown toward the heat-radiating plate 13 before entering the kitchen cabinet 60 via the heat-radiating holes 83 and 84. The air is then let out via another heat-radiating holes 85 and 86.

As described above, the three preferred embodiments of the present invention are provided respectively with a ventilating seat 51 having a ventilating hole 56 located horizontally at a level slightly higher than the surface of the kitchen, cabinet. In other words, the air is admitted and exhausted in a horizontal direction, thereby preventing the entry of the overflowing liquid into the inside of the heater.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. An induction heater housing for flush mounting on a surface, comprising:

a housing bottom pan disposable below the surface;

at least one air hole in said bottom pan;

a fan casing disposed within said bottom pan and communicating with said air hole;

a fan disposed within the fan casing for moving air into or out of the bottom pan;

a utensil-receiving plate coupled to edges of said bottom pan so as to at least partially cover a first portion of an upward open side of said bottom pan;

a control unit coupled to said bottom pan so as to at least partially cover a second portion of an upward open side of said bottom pan;

a vent coupled to said bottom pan so as to at least partially cover a third portion of an upward open side of said bottom pan, said vent being disposed proximal to an end panel of said bottom pan, said vent including an outside port, said port protruding above said plate distal said bottom pan and being configured to pass air in a horizontal direction away from the housing, said vent supporting said plate and being coupled to the end panel of said bottom pan, said vent including an internal passage communicating with said port and with an interior space of said bottom pan;

said internal passage including in cross section a generally L-shaped configuration, said L-shaped configuration being oriented such that a first arm of the L is downwardly directed and a second arm of the L is directed in the horizontal direction away from the housing;

said port extending horizontally beyond a rear end panel of said bottom pan;

said air hole being disposed through a bottom-most panel of said bottom pan;

said fan casing being of elongated strip-like construction and said fan being cylindrical;

said fan housing including a wind opening facing an interior of said housing;

said fan casing including tenons engaged in retaining holes of said bottom pan; and said retaining holes being disposed through the bottom-most panel of said bottom pan and said tenons extending downwardly.

* * * * *